US006023243A

United States Patent [19]

Frank

[11] Patent Number: 6,023,243

[45] Date of Patent: Feb. 8, 2000

[54] FLAT PLATE ANTENNA ARRAYS

[75] Inventor: Zvi Henry Frank, Elkana, Israel

[73] Assignee: MTI Technology & Engineering (1993) Ltd., Rosh Ha'ayin, Israel

[21] Appl. No.: 09/004,576

[22] Filed: Jan. 8, 1998

[30] Foreign Application Priority Data

Oct. 14, 1997 [IL] Israel ..... 121978

[51] Int. Cl.[7] ..... H01Q 1/38; H01Q 9/28

[52] U.S. Cl. ..... 343/700 MS; 343/795; 343/810

[58] Field of Search ..... 343/700 MS, 810, 343/814, 815, 795, 853, 812, 816, 820, 821, 753, 909; H01Q 1/38, 9/28

[56] References Cited

U.S. PATENT DOCUMENTS

| | | | |
|---|---|---|---|
| 4,099,181 | 7/1978 | Scillieri et al. | 343/876 |
| 4,121,220 | 10/1978 | Scillieri et al. | 343/768 |
| 4,150,383 | 4/1979 | Andersson et al. | 343/771 |
| 4,658,262 | 4/1987 | DuHamel | 343/792.5 |
| 4,716,415 | 12/1987 | Kelly | 343/771 |
| 4,804,965 | 2/1989 | Roederer | 343/700 MS |
| 4,819,003 | 4/1989 | Goto et al. | 343/771 |
| 4,959,658 | 9/1990 | Collins | 343/786 |
| 5,061,939 | 10/1991 | Nakase | 343/700 MS |
| 5,086,304 | 2/1992 | Collins | 343/778 |
| 5,182,570 | 1/1993 | Nysen et al. | 343/795 |
| 5,239,311 | 8/1993 | Ariumura et al. | 343/771 |
| 5,245,349 | 9/1993 | Harada | 343/700 MS |
| 5,291,210 | 3/1994 | Nakase | 343/700 MS |
| 5,402,134 | 3/1995 | Miller et al. | 343/742 |
| 5,408,243 | 4/1995 | D'Hont | 343/718 |
| 5,418,545 | 5/1995 | Pantsios et al. | 343/795 |
| 5,475,394 | 12/1995 | Kohls et al. | 343/700 MS |
| 5,483,248 | 1/1996 | Milroy | 343/785 |
| 5,512,913 | 4/1996 | Staney | 343/781 P |
| 5,526,004 | 6/1996 | Antipov et al. | 343/700 MS |
| 5,534,882 | 7/1996 | Lopez | 343/891 |
| 5,554,995 | 9/1996 | Jun | 343/700 MS |
| 5,554,999 | 9/1996 | Gupta et al. | 343/909 |
| 5,585,806 | 12/1996 | Ogino et al. | 343/700 MS |
| 5,606,334 | 2/1997 | Amarillas et al. | 343/840 |
| 5,625,366 | 4/1997 | D'Hont | 343/718 |
| 5,708,679 | 1/1998 | Fernandes et al. | 343/700 MS |
| 5,777,584 | 7/1998 | Rothe | 343/700 MS |
| 5,796,367 | 8/1998 | Andersson | 343/848 |

*Primary Examiner*—Hoanganh Le
*Attorney, Agent, or Firm*—Darby & Darby

[57] ABSTRACT

The invention comprises a flat panel antenna for microwave transmission. The antenna comprises at least one printed circuit board, and has active elements including radiating elements and transmission lines. There is at least one ground plane for the radiating elements and at least one surface serving as a ground plane for the transmission lines. The panel is arranged such that the spacing between the radiating elements and their respective groundplane is independent of the spacing between the transmission lines and their respective groundplane. A radome may additionally be provided which comprises laminations of polyolefin and an outer skin of polypropylene.

21 Claims, 6 Drawing Sheets

FIG. 1
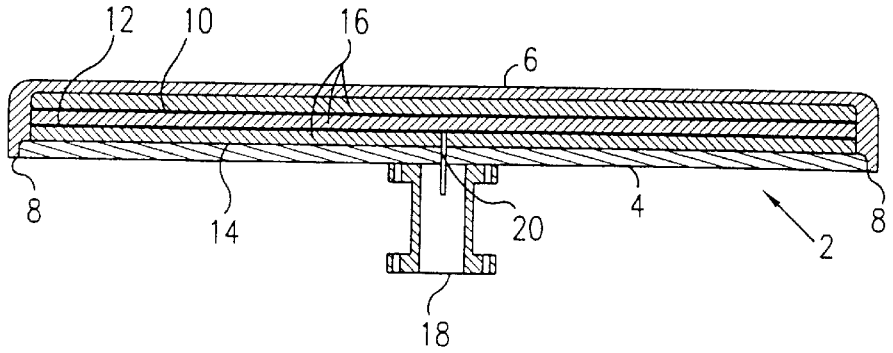
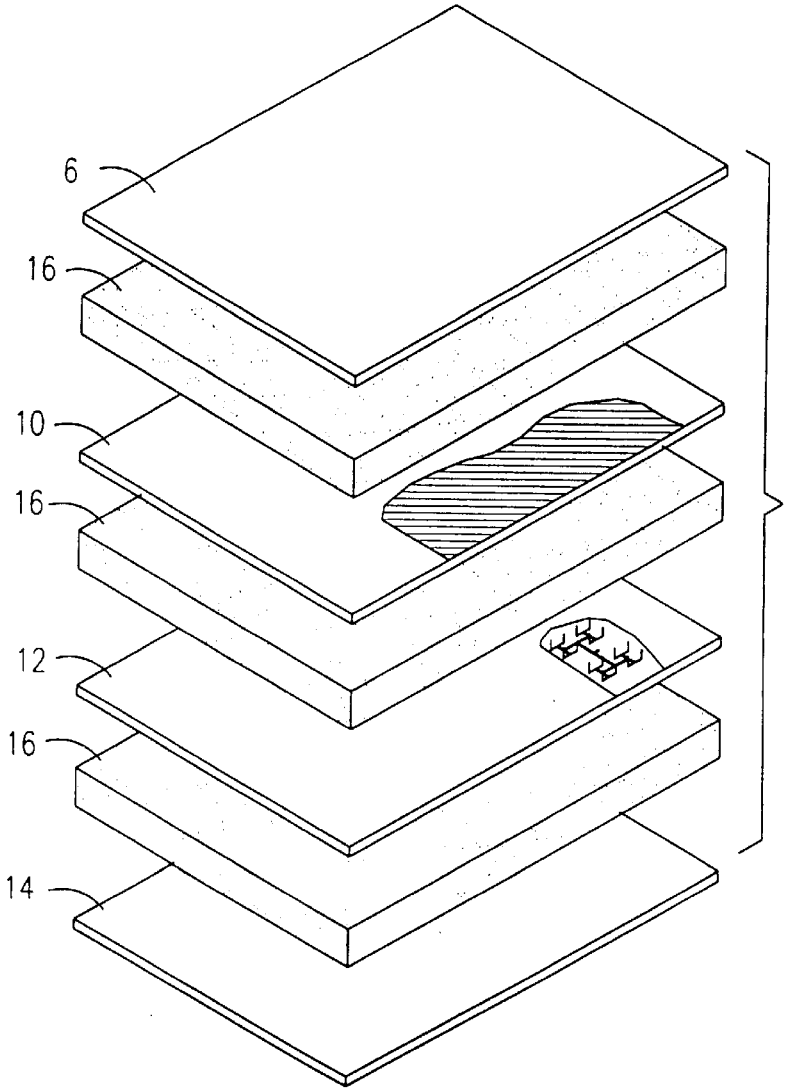
FIG. 2

FLAT PLATE ANTENNA ARRAYS

FIELD OF THE INVENTION

The present invention relates to flat plate antenna arrays and more particularly but not exclusively to flat plate antenna arrays for the transmission and reception of directional microwave communications.

BACKGROUND OF THE INVENTION

At microwave frequencies there is a range of antenna devices that can be used. These include slotted waveguide arrays, printed patch arrays, and reflector and lens systems. Above about 20 GHz slotted waveguide arrays require high tolerances and are thus expensive to manufacture in large quantities. For example at 20 GHz a large slotted waveguide array may need around 2000 slots, each of which must be individually machined to precise dimensions.

The aperture coupled patch array has all of the active elements of the antenna, radiating elements, transmission lines, coupled slots etc., on different layers of PCB. The elements are placed on the PCB using the conventional techniques of photo-lithography. In order for the device to work the layers must be very carefully lined up and must be carefully spaced apart. The tolerance limit for alignment and spacing between the layers is very tight and thus large arrays are difficult to mass produce.

Printed patch array antennas suffer from inferior efficiency due to high dissipative losses of transmission lines, particularly at high frequencies and for large arrays. In order to avoid radiation losses from the lines it is necessary to keep the spacings within the order of $0.01\lambda$. Furthermore the restrictions on spacing mean that the transmission lines must be very thin. As they are thin they will have high losses and thus be inefficient for large arrays. Frequency bandwidths for such antennas are typically less than that which can be realized with slotted planar arrays, that is to say they are particularly narrow.

Reflector and lens arrays are generally employed in applications for which the additional bulk and weight of a reflector or lens system are deemed to be acceptable. The absence of discrete aperture excitation control in traditional reflector and lens antennas limit their effectiveness in low sidelobe and shaped beam applications.

Increasingly, as such antennas are becoming more widespread, and concern for the quality of the environment is growing, the use of lens or reflector systems is becoming less and less publicly acceptable. It is therefore desirable to provide a flat plate antenna array having the advantages of a lens or reflector but without the environmental impact.

SUMMARY OF THE INVENTION

It is therefore an aim of the present invention to provide a flat plate antennas for use in various parts of the 15–40 GHz range that is relatively easy to manufacture and has the qualities generally considered necessary for directional microwave transmission.

According to a first aspect of the present invention there is provided an antenna comprising at least one printed circuit board, and having active elements including radiating elements and transmission lines, and at least one ground plane for the radiating elements and at least one surface serving as a ground plane for the transmission lines, arranged such that the spacing between said radiating elements and said at least one groundplane therefor is independent of the spacing between said transmission lines and said at least one surface serving as a groundplane therefor.

In an embodiment the printed circuit board has a first face and a second, opposing, face and the active elements are located on both faces of said printed circuit board. The transmission lines of the first face may overlay the transmission lines of the second face.

In a preferred embodiment the transmission lines may extend outwardly from a central feed point. The radiating elements may extend from outward ends of the transmission lines. The electrical paths from the central feed point to each radiating element respectively through said transmission lines are preferably substantially the same, in terms of physical length and/or in terms of electrical impedance. Thus the antenna is electrically balanced. All the radiating elements are being fed with the same power and thus the antenna works with maximum bandwidth.

In an embodiment the radiating elements of each face extend at predetermined angles from ends of the transmission lines and a predetermined angle which is used primarily in the first face differs from the predetermined angle used primarily in the second face by 180°.

The printed circuit board may be of a predetermined thickness. The thickness of the PCB is a compromise between low loss, minimum extraneous radiation and cost. It is important for the correct interaction between the elements of the two faces that the thickness of the printed circuit board is made to within a certain tolerance.

Embodiments of the antenna may further comprise a polariser. The polarizer may be a grid polarizer.

The radiating elements may be arranged in rows about a central axis such that the rows are aligned parallel to the axis. The radiating elements may be aligned parallel to a second axis. The second axis may be offset from the central axis by substantially 45°. The antenna may be orientated such that the central axis is either horizontal or vertical. Thus the antenna may be either vertically or horizontally polarized.

The number of radiating elements per row of the pattern is a function of the distance of each respective row from the central axis. That is to say each row may have a predetermined number of radiating elements and that predetermined number may increase with the proximity of each respective row to the central axis. Such an arrangement decreases the size of directional side lobes.

The antenna may further comprise a ground plate located at a predetermined distance from the printed circuit board. The predetermined distance would typically be less than a quarter of the wavelength of the signal.

In a preferred embodiment individual transmission lines split into two or more transmission lines at each of a plurality of branch points. The total impedance when taken in parallel, of the further lines following respective branch points is equal to the impedance of the individual transmission line preceding the respective branch point. The impedance of the branches is seen as a parallel impedance by the central feed point and the intention is to keep the impedance constant along the length of the transmission lines.

An embodiment of the array has the elements fed in a series/parallel fashion. This is done to reduce further losses in the transmission lines and improve efficiency.

Embodiments of the antenna may be used for transmitting or receiving one or more wavebands within the 13–40 GHz range.

The antenna may typically be sealed from the environment by a radome. The radome may comprise a rigid polypropylene skin and a foamed polyethylene body, the body being comprised of approximately 80% cross-linked polymer, the skin preferably being UV protected, and both the skin and the body being held together, preferably by soldering.

According to a second aspect of the present invention there is provided an antenna comprising at least one printed circuit board, and having active elements including radiating elements and transmission lines, mounted on said printed circuit board, and at least one ground plane for the radiating elements and at least one surface serving as a ground plane for the transmission lines. The radiating elements are arranged in rows, which are parallel to a central axis of the antenna, and the radiating elements are elongated, and arranged with their elongated directions parallel to an axis offset from the central axis of the antenna.

According to a third aspect of the invention there is provided an antenna comprising at least one printed circuit board having two oppositely facing printed surfaces, and having active elements including radiating elements and transmission lines mounted on the oppositely facing surfaces, and at least one ground plane for the radiating elements and at least one surface serving as a ground plane for the transmission lines, wherein the transmission lines on the oppositely facing surfaces overlay each other and the radiating elements on the oppositely facing surfaces do not overlay each other.

According to a fourth aspect of the present invention there is provided an antenna comprising at least one printed circuit board, and having active elements including radiating elements and transmission lines, and at least one ground plane for the radiating elements and at least one surface serving as a ground plane for the transmission lines. The radiating elements are arranged in rows about a central axis of the antenna and the number of radiating elements per row decreases with the distance of the row from the central axis.

A preferred embodiment of the invention is an antenna comprising at least one printed circuit board, and having active elements including radiating elements and transmission lines, and at least one ground plane for the radiating elements and at least one surface serving as a ground plane for the transmission lines, arranged such that the spacing between said radiating elements and said at least one groundplane therefor is independent of the spacing between said transmission lines and said at least one surface serving as a groundplane therefor. The printed circuit board has a first surface and a second, opposing, surface and the active elements are located on both surfaces of said printed circuit board. The transmission lines of the first surface overlay the transmission lines of the second surface. The radiating elements are arranged in rows, which are parallel to a central axis of the antenna. The radiating elements are also elongated, and arranged with their elongated directions parallel to an axis offset from the central axis of the antenna. The radiating elements on the oppositely facing surfaces do not overlay each other. A predetermined number of elements is arranged in each row and that number decreases with the distance of the row from the center of the array.

According to a fifth aspect of the invention there is provided a radome for sealing an antenna. The radome comprises an outer skin and an inner body. The outer skin and the inner body may both comprise polyolefins. The inner body may be 80% cross-linked polymer. These materials are chosen for their transparency to RF radiation and, as well as the radome, may also be used for the spacers within the antenna.

The spacer may have up to 80% of cross-linked polymer, which level is determined by a specific foaming process that is used. The process is chosen to provide small cell size and extreme uniformity of the foam.

Polymers of a single group (polyolefins) have low adhesion, and the layers or laminations are preferably bonded together by a form of soldering in which no glue is used in the bonding process. The presence of glue in the material is harmful in that it increases the propensity of the material to absorb radiation. An advantage of the materials being of the same group is that the bonding is more secure.

In an embodiment the outer skin comprises polypropylene. In a preferred embodiment the inner body comprises polyethylene.

BRIEF DESCRIPTION OF THE DRAWINGS

For a better understanding of the invention and to show how the same may be carried into effect, reference will now be made, purely by way of example, to the accompanying drawings in which, FIG. 1 is a cross-sectional view of a microwave antenna according to a first embodiment of the present invention, FIG. 2 is an exploded view of the device of FIG. 1.

DESCRIPTION OF THE PREFERRED EMBODIMENTS

Figure 3:
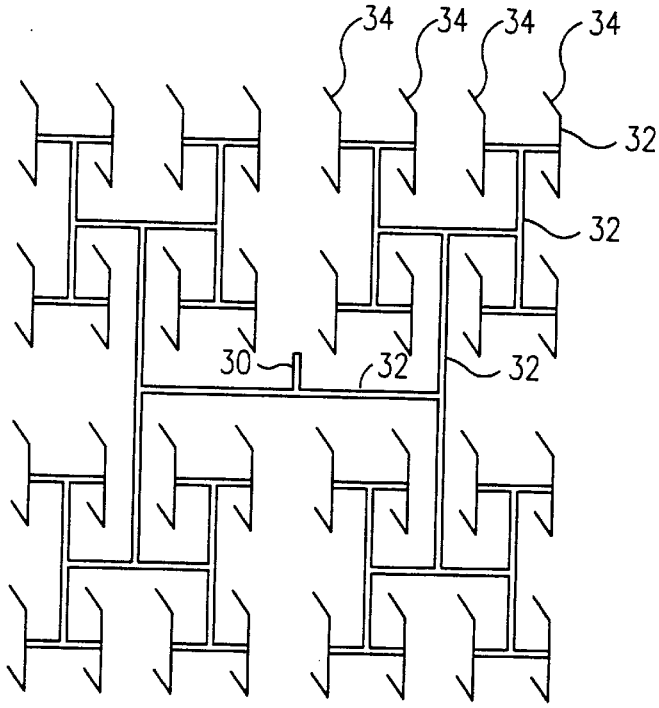
FIG. 3 shows a view from above of the upper layer of a PCB using a corporate feed and adapted for use with the invention.

FIG. 1 shows a cross-sectional view of a microwave antenna according to a first embodiment of the present invention. In FIG. 1 a flat plate antenna 2 comprises a mounting plate 4 and a box or radome 6, bonded together at a bonding surface 8. The mounting plate 4 and radome 6 enclose a void in which is placed an antenna printed circuit board 12, a polariser 10 and a groundplane 14, separated by foam spacers 16. The PCB is connected to a waveguide 18 via a waveguide microstrip adapter 20. The waveguide microstrip adapter 20 serves as a transition between the output of the waveguide and the printed circuit board.

FIG. 2 is an exploded diagram of the device shown in cross-section in FIG. 1.

As mentioned above, in the aperture coupled patch antenna the layers of PCB with the various active elements must be very carefully lined up and must be carefully spaced apart. In order to avoid radiation and surface wave losses in the printed patch array it is necessary to keep the spacings within the order of $0.01\lambda$. Furthermore the narrow spacings mean that the transmission lines must be very thin. As they are thin the transmission lines will he lossy and hence the antenna inefficient for large arrays.

In embodiments of the invention the active elements, that is to say the radiating elements and the transmission lines, are all mounted on a single PCB. Both sides of the PCB are used. The manufacturing of the PCB is a very precise process. The thickness must be tightly controlled and the photolithography must be very accurately done. However assembly of the antenna following manufacture of the PCB does not require tight tolerances at all. The PCB 12 must be spaced correctly with respect to the ground plane 14, but the spacing involved here, of the order of a quarter of a wavelength, is not critical.

Because of the more lax spacing requirements the transmission lines can be thicker. This means that they can also be wider. The impedance of the transmission line is inversely proportional to the width of the line, and thus the wider lines are less lossy.

The polariser, in addition to its having a polarizing function, is also designed to reduce radiation losses from the transmission lines.

FIG. 3 shows a plan view of the printed, two-dimensional, surface of a PCB, which comprises an antenna element. The antenna element itself is a printed dipole antenna. The array is fed from the center 30. This form of feed is known as a corporate feed. Transmission lines 32 branch outwardly from the center of the pattern, that is to say from the feed point, and terminate in radiating elements 34 at each termination of a transmission line. A corporate feed has the advantage that all lines are in phase and thus it achieves wide bandwidth. A key feature of the arrays used in the present invention is that, despite the fact that the path to each radiating element 34 is identical in length, and that all elements are fed with equal amplitudes, the antenna is able to produce low side lobes and operate at high efficiency.

Figure 4:
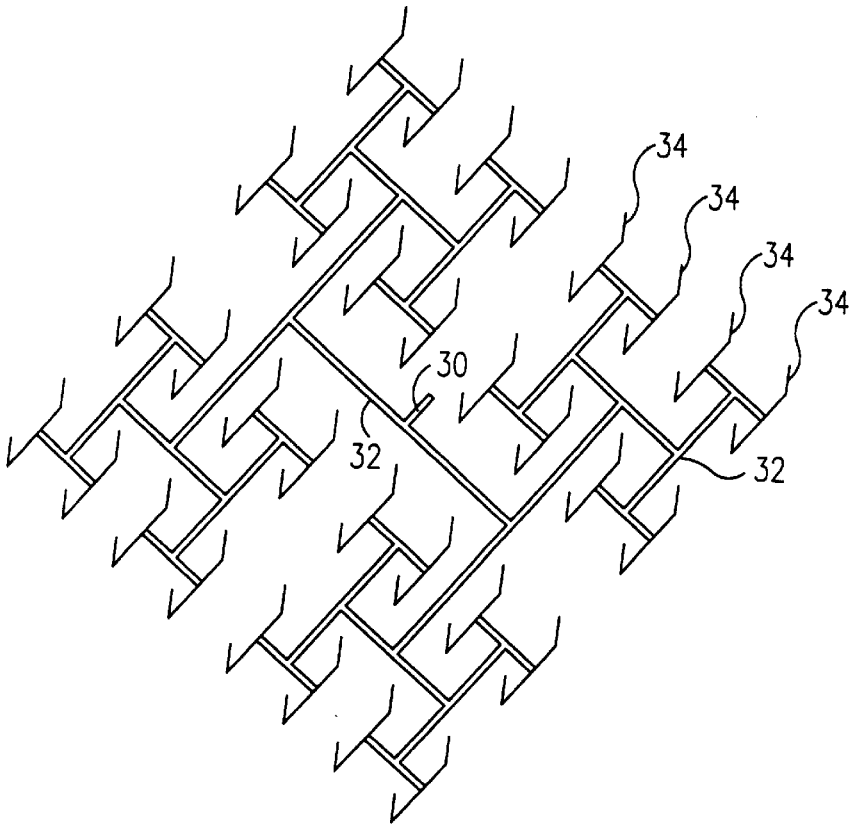
FIG. 4 is the upper layer of the PCB of FIG. 3, orientated to minimize directional sidelobes.

The radiating elements 34 preferably extend from the transmission lines 32 at an angle of substantially 45 degrees. The antenna may be used with these elements in the vertical orientation, as shown in FIG. 4. In this diamond orientation, vertical rows comprise a decreasing number of elements as one moves away from the center. Such an orientation is used to decrease the size of directional sidelobes, and at the same time allows each radiating clement to operate at substantially the same power level. Previous attempts to improve side-lobe performance have involved making the transmission lines of different widths. This has the disadvantage that the radiating elements radiate at different power levels and, as a consequence are generally less efficient.

Alternatively the antenna may be used with the radiating elements in a horizontal direction. In such an orientation the first side-lobes are just as low, <−25 dB. The antenna may be used together with a polariser in order to improve the cross-polarization performance, that is to say to boost it to 30 dB and beyond. The use of the polariser is optional and depends on the particular application.

It will be appreciated that, whether the radiating elements are positioned to be horizontal or vertical the antenna takes on the diamond shape of FIG. 4. It is possible to put two or more such diamond shapes together to make a composite antenna. Such a composite antenna may be advantageous in certain applications.

In an alternative embodiment the radiating elements are not at an angle of 45°. Instead, straight elements are used, and this is done where low side lobes are not required.

Figure 5:
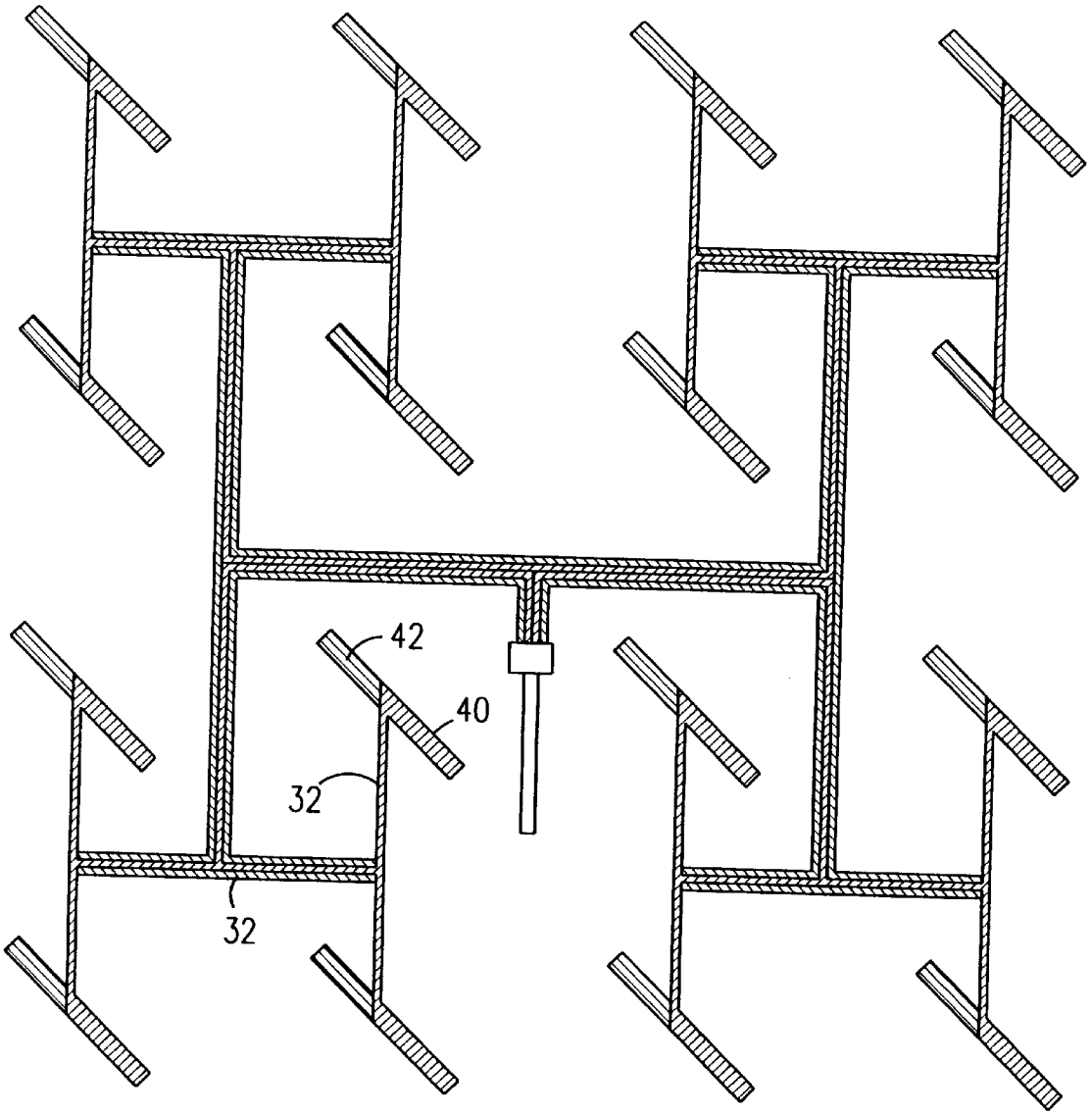
FIG. 5 is a schematic view of two surfaces of part of the PCB of FIG. 2 shown superimposed.

The array in FIG. 3 represents the array printed on one side of the PCB. On the opposite side of the PCB a complementary pattern is printed. The complementary pattern relates to the first pattern in that the respective transmission paths overlay one another. The radiating elements of the second pattern however, extend outwards from the terminations of the transmission lines in the opposite directions, at an angle of 180 degrees from the first radiating elements. FIG. 5 shows a termination of a transmission element in which the two radiating elements 40 and 42, from the top surface and the bottom surface respectively of the PCB, are shown superimposed.

It is necessary that all of the sections of the transmission line 32 should appear to the central feed 30 to have the same impedance. The outer portions appear to be connected in parallel from the point of view of the central feed 30 and thus the sections that are further out should preferably have higher impedances than the sections that are closer to the central feed. This is achieved quite simply in the present invention in two ways. The first is to make the outer sections of the transmission lines thinner than the inner sections towards the central feed 30. As each branch point is reached the thickness of the line is very approximately halved as the line splits in two. The precise relationships of the thicknesses is non-linear. In certain embodiments the amount of branching may be such that the thickness needed at the center would be unmanageable. Thus a second way is to use a transformer at a branch point. In a preferred embodiment the two methods are used alternatively. A 50Ω line is followed by two 100Ω lines. The two 100Ω lines ere each followed by transformers and the series is repeated with further 50Ω lines.

The impedance of the radiating elements must also be tightly controlled and this is related to the spacing between the respective PCB surfaces and the groundplane 14.

The bandwidth of the radiating element is independent of the dimensions of the transmission lines. This is because the radiating elements and the transmission lines use separate ground planes. In respect of the transmission lines the opposite face of the PCB serves as the groundplane. The separate groundplane 14 is for the radiation elements. It will be recalled from the description of FIG. 3 that the transmission lines of the two faces of the PCB overlay each other. Hence the opposite transmission line is able to serve as a groundplane in each case. However the radiation elements do not overlay each other and therefore the separate groundplane 14 is effective.

Flat patch array antennas of the prior art generally have bandwidths of around 1 to 4%. Embodiments of the present invention can achieve bandwidths in the region of 20%. This invention is particularly useful in large arrays where gain requirements are greater than 32 dBi. A flatness of the gain peak of 0.5 dB over a wide band can generally be achieved. A minimum cross-polarization of 30 dB can also be achieved.

Figure 6:
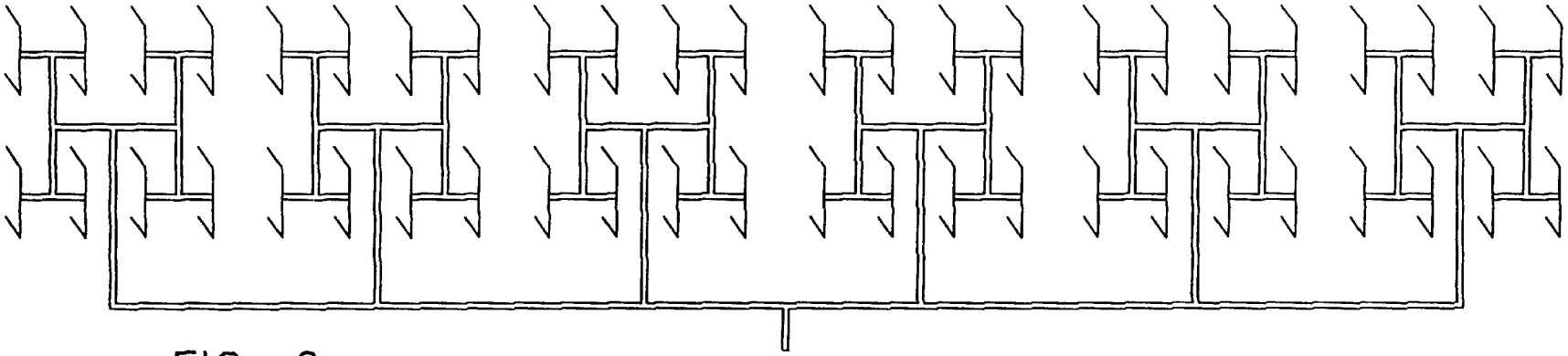
FIG. 6 is a view of the upper layer of a series/parallel feed.
Figure 7:
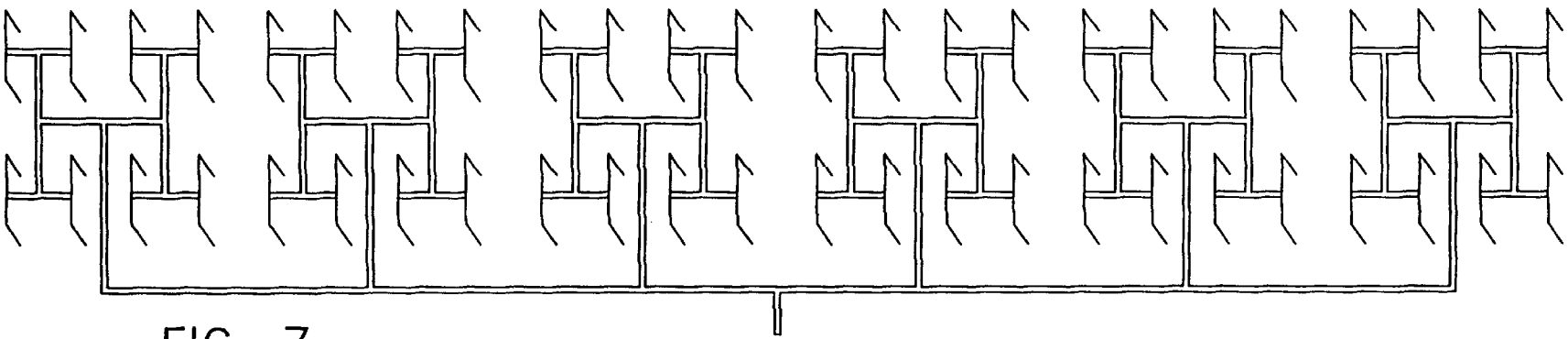
FIG. 7 is a view of a lower layer of a series/parallel feed.

FIGS. 6 and 7 show upper and lower layers respectively of a series parallel feed for use in embodiments of the present invention. The series parallel feed reduces losses in the transmission lines and thus improves efficiency. The series parallel array is advantageously used when the maximum bandwidth made available by the invention is not required.

Figure 8:
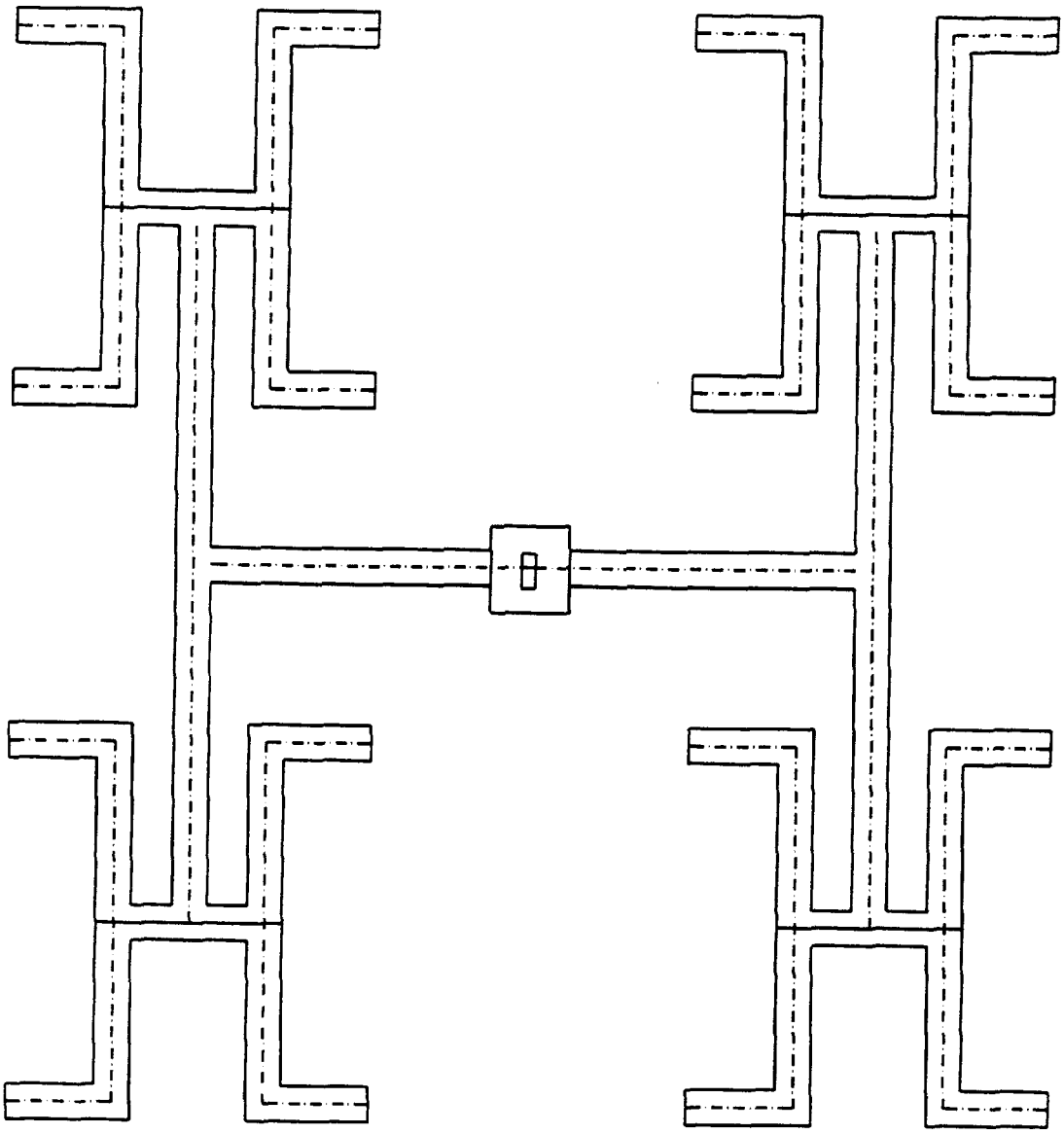
FIG. 8 is a view of a waveguide power divider.

FIG. 8 shows a waveguide power divider for use with the present invention. In a preferred embodiment a number of arrays can be added together by means of a waveguide power divider, and FIG. 8 shows, by way of example, a 16-way divider. A problem with PCBs is that, especially at high frequencies, large numbers of radiating elements are needed. To include each one of them on the same PCB requires a large PCB with long transmission lines. Transmission lines on a PCB are less efficient than waveguides. Thus it is more efficient to have several small PCBs connected by a waveguide power divider.

The antenna is sealed from the environment using the radome 6. In general foamed plastic is used in radomes and the reason is that, at the wavelengths at which the antenna operates, materials in general absorb energy from the radiation. Foamed plastic is less dense than most materials and therefore absorbs less energy, and it is a general object of the design of a radome to minimize the absorption of energy.

In the prior art the plastic used in the radome is foamed using a foaming agent. The radome has an inner body of foamed plastic, and an outer skin which need not be foamed and which is tougher than the body, to give the antenna an outer rigidity.

In embodiments of the present invention the radome is constructed of polyolefin materials. The materials may be laminated. The laminations are soldered together. The material in the body is typically foamed polyethylene and the material in the skin is typically the more rigid polypropylene. Polyethylene foam is typically an 80% cross-linked polymer and is manufactured in a mold. The laminations are obtained by peeling with an appropriate form of knife. The fact that both the materials are polyolefins makes the bond that much more secure.

Figure 9:
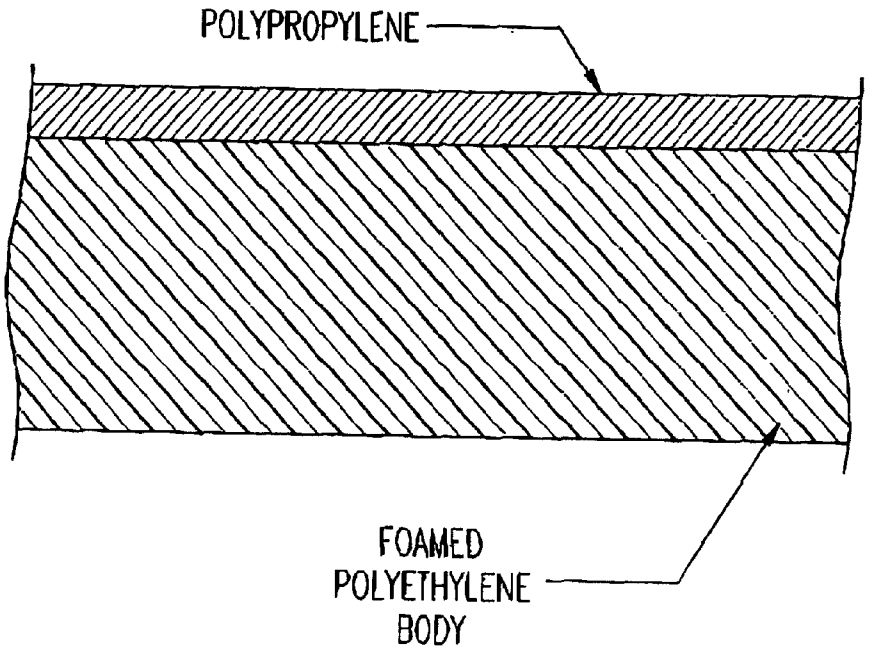
FIG. 9 is a simplified diagram showing a cross-sectional view of a radome.

FIG. 9 shows a cross-sectional view of a radome of the type mentioned above, having a polypropylene skin and a foamed polyethylene body.

Polypropylene, the more rigid of the two materials, and the one that is used in the skin, is vulnerable to UV damage from sunlight, and therefore it is advisable to cover the radome with a UV mask, or to make it of a UV resistant polypropylene compound.

Advantages provided by embodiments of the invention may include the following: The spacing between the radiating element and the groundplane is independent of the thickness of the transmission lines or feed lines. In the prior art, the aperture fed microstrip patch has complex spacing and alignment requirements between adjacent elements. Such restriction does not occur in the invention.

The bandwidth of the radiating element is independent of radiation and surface losses of the feed lines. The bandwidth of the radiating element is a function of the spacing between it and the lower ground plane, which spacing defines about one quarter of the dielectric wavelength.

A bandwidth of up to 20% is possible. The transmission lines are designed for minimum loss only. This is because radiation loss in the feed line is proportional to the height of the PCB substrate. The feed line can be designed with optimum substrate height and thus losses can be minimized. In the prior art, in which a single ground plane was used, this cannot be done as decreasing the height of the radiating element leads to a reduction in bandwidth. Since two groundplanes are now used is possible to design the radiating element for optimum bandwidth (large gap to groundplane) and the transmission lines for minimum loss. (small gap to groundplane)

Cross polarization is reduced considerably using a grid polariser. The polariser is arranged to be orthogonal to the polarization of the elements of the antenna.

The orientation of the array and the radiating elements reduces the size of the directional sidelobes.

Complex distribution networks, of the type known in the prior art, are not necessary, and neither is accurate positioning between layers.

It is appreciated that the various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

I claim:

1. An antenna comprising at least one printed circuit board, and having active elements including radiating elements and transmission lines, and at least one ground plane for the radiating elements and at least one surface serving as a ground plane for the transmission lines, arranged such that the spacing between said radiating elements and said at least one groundplane therefor is independent of the spacing between said transmission lines and said at least one surface serving as a groundplane therefor, wherein said at least one printed circuit board has a first surface and a second, opposing, surface, wherein said active elements are located on both said first and said second surfaces of said printed circuit board, wherein said transmission lines of said first surface overlay said transmission lines of said second surface, such that transmission lines on said second surface provide said at least one surface serving as a groundplane to said transmission lines of said first surface, wherein said at least one surface serving as a groundplane is the only groundplane for said transmission lines, wherein a plurality of said radiating elements extend from said transmission lines at angles of substantially 45 degrees;

wherein said radiating elements are arranged in vertical rows about a central axis of the antenna; and wherein the number of radiating elements per vertical row decreases with the distance of said row from said central axis.

2. The antenna according to claim 1, wherein said transmission lines extend outwardly from a central feed point, wherein said radiating elements extend from outward ends of said transmission lines and wherein electrical paths from said central feed point to each radiating element respectively through said transmission lines are substantially the same.

3. The antenna according to claim 2 wherein said electrical paths are substantially the same in terms of electrical impedance.

4. The antenna according to claim 2, wherein said electrical paths are the same in terms of physical distance.

5. The antenna according to claim 2 wherein individual transmission lines split into further transmission lines at a plurality of branch points, and wherein a total electrical impedance of said further transmission lines as seen in parallel is substantially equal to an electrical impedance of said individual transmission line preceding each respective branch point.

6. The antenna according to claim 1, wherein said radiating elements of each face extend at predetermined angles from ends of said transmission lines and wherein said predetermined angle of said first face differs from said predetermined angle of said second face by 180°.

7. The antenna according to claim 1, wherein said printed circuit board is of a predetermined thickness.

8. The antenna according to claim 7 wherein said predetermined thickness is chosen to minimize impedance in said transmission lines.

9. The antenna according to claim 1, further comprising a polariser.

10. The antenna according to claim 1, wherein said radiating elements are located at a predetermined distance from said at least one groundplane therefor, which predetermined distance is chosen to maximize bandwidth.

11. The antenna according to claim 10, wherein said predetermined distance is approximately a quarter of a wavelength.

12. An antenna comprising at least one printed circuit board, and having active elements including radiating elements and transmission lines, mounted on said printed circuit board, and at least one ground plane for the radiating elements and at least one surface serving as a ground plane for the transmission lines, wherein a plurality of said radiating elements are elongate and extend from said transmission lines at angles of substantially 45 degrees;

wherein said radiating elements are arranged in vertical rows parallel to a central axis of the antenna; and wherein the number of radiating elements per vertical row decreases with the distance of said row from said central axis.

13. The antenna according to claim 12 comprising at least said printed circuit board, which printed circuit board has two oppositely facing printed surfaces, and wherein said active elements include radiating elements and transmission lines mounted on said oppositely facing surfaces, and wherein the transmission lines on said oppositely facing surfaces overlay each other and said radiating elements on said oppositely facing surfaces do not overlay each other.

14. The antenna according to claim 13, for receiving one or more wavebands within the 13–40 GHz range.

15. The antenna according to claim 13, further comprising a radome, for sealing said antenna from the environment.

16. The antenna according to claim 15 wherein said radome comprises a foamed polyethylene body and a polypropylene skin, said body comprising approximately 80% cross-linked polymer.

17. The antenna according to claim 16 wherein radiating elements extend at predetermined angles from ends of said transmission lines.

18. The antenna according to claim 13 wherein at least some of said radiating elements extend from said transmission lines at angles of substantially 135°.

19. An antenna comprising at least one printed circuit board, and having active elements including radiating elements and transmission lines, mounted on said printed circuit board, and at least one ground plane for the radiating elements and at least one surface serving as a ground plane for the transmission lines, wherein a plurality of said radiating elements are elongate and extend from said transmission lines at angles of substantially 45 degrees;

wherein said radiating elements are arranged in vertical rows parallel to a central axis of the antenna; and wherein the number of radiating elements per vertical row decreases with the distance of said row from said central axis.

20. The antenna according to claim 19, connected to a waveguide power divider, said waveguide power divider being connectable simultaneously to other antennae.

21. An antenna comprising at least one printed circuit board, and having active elements including radiating elements and transmission lines, and at least one return path for the radiating elements and at least one surface serving as a return path for the transmission lines, arranged such that the spacing between said radiating elements and said at least one return path therefor is independent of the spacing between said transmission lines and said at least one surface serving as a return path therefor, wherein said at least one printed circuit board has a first surface and a second, opposing, surface and wherein said active elements are located on both surfaces of said printed circuit board, wherein said transmission lines of said first surface overlay said transmission lines of said second surface, such that transmission lines on said second surface provide said at least one surface serving as a return path to said transmission lines of said first surface, wherein said at least one surface serving as a return path is the only return path for said transmission lines, wherein a plurality of said radiating elements extend from said transmission lines at angles of substantially 45 degrees;

wherein said radiating elements are arranged in vertical rows about a central axis of the antenna; and wherein the number of radiating elements per vertical row decreases with the distance of said row from said central axis.

* * * * *